US005454253A

United States Patent [19]

Mueller

[11] Patent Number: 5,454,253

[45] Date of Patent: Oct. 3, 1995

[54] REDDRAW MECHANISM FOR CAN BODY MAKER APPARATUS

[75] Inventor: Peter M. Mueller, Littleton, Colo.

[73] Assignee: Aluminum Company of America, Pittsburgh, Pa.

[21] Appl. No.: 174,232

[22] Filed: Dec. 28, 1993

[51] Int. Cl.[6] ..... B21D 22/28

[52] U.S. Cl. ..... 72/349

[58] Field of Search ..... 72/347, 349, 350, 72/351

[56] References Cited

U.S. PATENT DOCUMENTS 3,696,657 10/1972 Maytag ..... 72/456

4,807,459 2/1989 Grims et al. ..... 72/347

*Primary Examiner*—Lowell A. Larson

*Attorney, Agent, or Firm*—Thomas R. Trempus

[57] ABSTRACT

An improved can body maker apparatus has a redraw system of reduced mass. An air actuator is incorporated into the redraw motion assembly to maintain a cam actuated arm in contact with a cam surface during the reform cycle. A improved mechanical linkage eliminates the conventional redraw carriage. The redraw sleeve is supported within a fluid bearing mounted in a stationary housing.

21 Claims, 10 Drawing Sheets

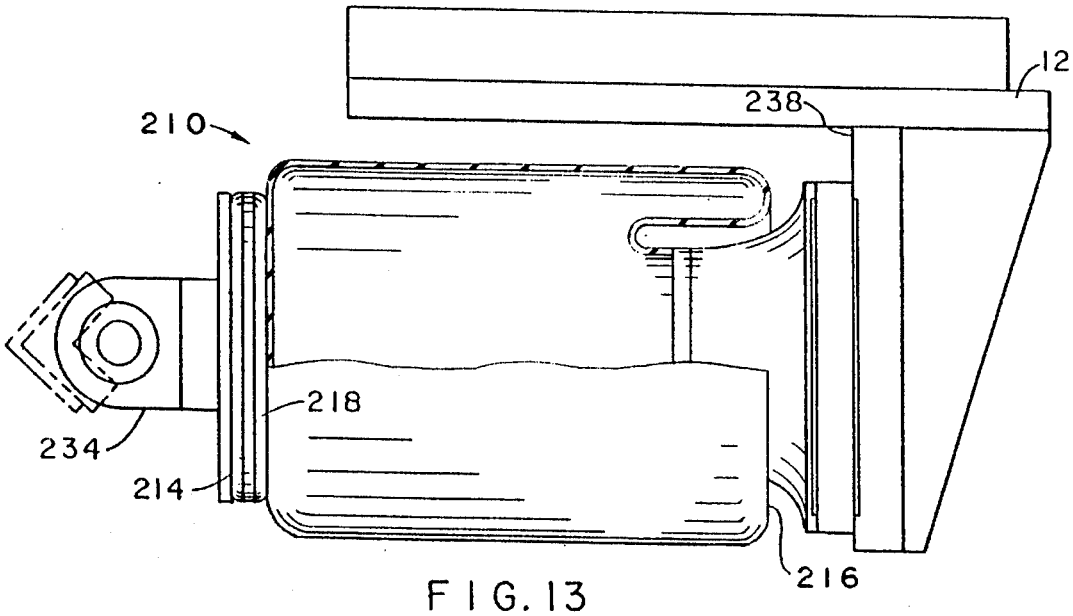
FIG. 13
FIG. 14
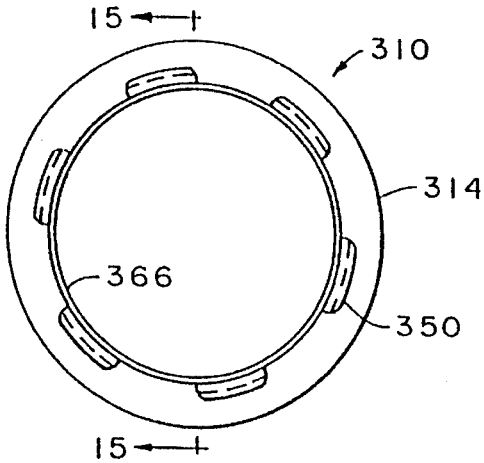
FIG. 15
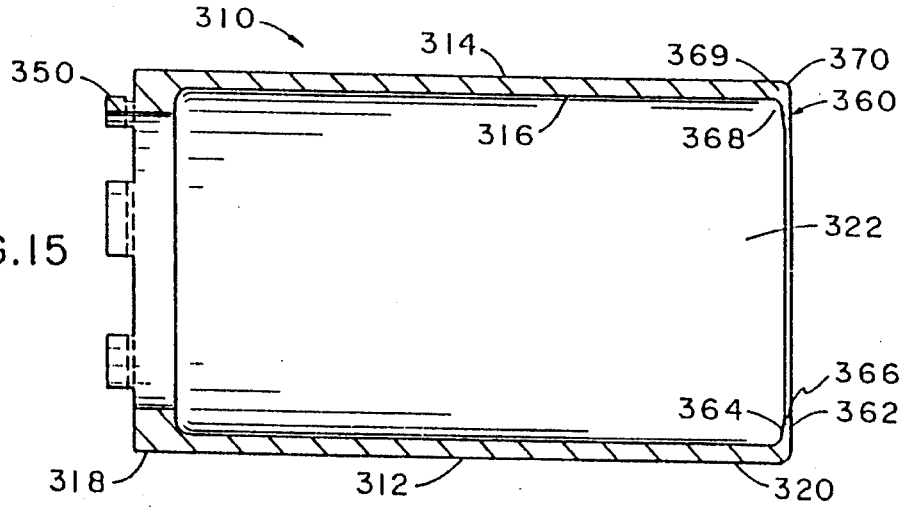

REDDRAW MECHANISM FOR CAN BODY MAKER APPARATUS

FIELD OF THE INVENTION

This invention relates generally to can body makers and more particularly to the redraw system of a can body maker. The improved redraw system includes linkage translating the cam actuated pivotal motion of an actuating, or pull, rod into straight line motion. The invention also includes an improved light weight redraw sleeve assembly with interchangeable fluid bearings. The invention facilitates the change over of a body maker between can diameters.

BACKGROUND OF THE INVENTION

A conventional can body maker apparatus is disclosed in U.S. Pat. No. 3,696,659, issued to J. H. Maytag and an improvement to the ram assembly of the can body maker ram assembly is disclosed in U.S. Pat. No. 4,934,169, issued to C. M. Grimes, et al. Both of these patents are assigned to Adolph Coors Company. An example of a conventional redraw system is also described in U.S. Pat. No. 3,735,629, issued to Elpidofor Paramonoff, and assigned to Standun Inc. The aforedescribed patents are incorporated herein by reference as if fully set forth. The assignee of the instant invention is also the assignee of co-pending application, "Improved Body Maker Apparatus," Ser. No. 899,201, which discloses a counterbalance mass system that improves the speed and efficiency of can body makers.

Can body makers produce elongated can bodies from shallow metal cups or can shells. The can shells have a wall thickness of approximately 0.009 to 0.012 inch, and the elongated can bodies have a wall thickness reduced to approximately 0.0045 inch. In a conventional can body maker apparatus, a ram is movably mounted for reciprocal, straight line motion at rates sufficient to form from between 180 and 220 can bodies per minute. The stroke length, that is the distance traveled by the movable ram, is between about 18 to 26 inches. As a general rule, for a given can body maker, the shorter the ram stroke, the greater the rate or number of cycles per minute at which the ram can be operated. Misalignment as small as between about 0.0005 and 0.0010 inch can result in the formation of defective cans. In conjunction with the reciprocal motion of the ram, a redraw sleeve is supported in a redraw assembly. The redraw sleeve engages the shell prior to contact by the ram, applying a restraining force against the shell as it is worked through a redraw die. The redraw process elongates the sidewalls of the can shell and decreases the sidewall thickness and overall diameter of the can shell. The redraw operation is followed by two or three ironing stations that further elongate and thin the walls of the can shell to form a one piece can body. Finally, the body maker can be equipped with a doming station that further forms the enclosed bottom of the can body into a desired structural configuration.

The redraw assembly operates at the same rate of reciprocation as the ram assembly. Mechanical linkage is provided between the main crank shaft of the can body maker and both the ram assembly and the redraw assembly. The specific linkage translating the motion of a cam mechanism into the linear straight line motion required by the redraw assembly includes a leader pin, redraw head, cam follower, idler arm, push rod, and an air spring/air cylinder, all of which are required to effect the reciprocal motion of a redraw sleeve carriage assembly. In order to minimize the potential for misalignment, in conventional body makers, the redraw sleeve carriage is supported on a track way that is parallel with the ram assembly. Needless to say, a significant amount of mass is being reciprocated in the redraw carriage assembly and this mass can contribute to the misalignment problem discussed above. A biasing system such as an air spring/air cylinder is in communication with the redraw assembly and supplies the force necessary to maintain the cam follower in contact with the cam mounted on the crank shaft. The air spring/air cylinder system is a complex assembly that includes an air cylinder, surge tank, and connecting hoses that require significant attention during operation and continuous maintenance.

SUMMARY OF THE INVENTION

According to this invention, an improved redraw system for a can body maker actuator system includes a new cam system, an improved redraw sleeve, a stationary housing with an improved fluid bearing adapted to support the redraw sleeve, improved biasing mechanism, and unique linkage that translates the motion of the crank shaft actuated cam and cam follower into the linear motion of the redraw sleeve.

The body maker apparatus includes a frame on which is supported a drive mechanism including a cam surface and a crank, both adapted for rotation about a first axis mounted in the frame. A ram means is mounted in a ram carriage or a fluid bearing support for reciprocal, straight line motion in the frame. A connecting rod is operatively associated with the crank and imparts reciprocal motion to the ram. A redraw system operates in cooperation with the ram to form can blanks, or shallow cups, into elongated can bodies. A stationary structure mounted within the frame houses an improved fluid bearing in which the redraw sleeve is supported for reciprocal straight line motion. The fluid bearing incorporates an improved fluid porting system that eliminates the need for multiple fluid inlet and outlet ports. An actuating bar, or pull rod, is in mechanical communication with the cam surface such that the cam surface imparts generally non-linear reciprocal motion to the actuating bar.

An improved biasing means maintains the actuating bar in tension throughout the redraw cycle and in operative communication with the cam. The biasing means is a substantially self contained air bag actuator that is mounted in the frame of the body maker and in mechanical communication with the actuating bar. In the present invention, a unique redraw linkage is mounted in the frame and translates the non-linear reciprocal motion of the cam actuated pull rod into linear, reciprocal motion in the redraw sleeve.

The redraw system of this invention is adapted to incorporate an improved redraw sleeve that is the subject of applicants' co-pending U.S. patent application Ser. No. 174,134, entitled, "Improved Can Body Maker With Flexible Redraw Sleeve." Additionally, an improved redraw system biasing mechanism that is incorporated into the present invention is also adaptable for retrofit into existing body maker systems. This alternative application of the redraw biasing system is the subject of applicants' co-pending U.S. patent application Ser. No. 174,237, entitled, "Improved Can Body Maker Apparatus with Air Actuator Redraw Mechanism."

It is an object of this invention to provide an improved redraw system for use in a can body maker apparatus.

It is also an object of this invention to eliminate the conventional air spring/air cylinder system and redraw carriage that are employed in the conventional redraw system.

It is again an object of this invention to provide an improved redraw system capable of increased redraw pressure selectability.

It is yet another object of this invention to provide an improved structure for the support and alignment of a redraw sleeve while minimizing the amount of mass being reciprocated in conjunction with the redraw operation.

It is an object of this invention to provide an improved cam system in which an actuating rod in mechanical communication between the crank driven cam and the redraw linkage is maintained in tension.

It is another object of this invention to improve the speed of can body makers through reducing the number of components and the mass of the components in the redraw system.

It is an object of this invention to allow variations of the stroke length without changing the cam, and to provide a variable stroke length system having the same velocity and acceleration profile for all strokes.

It is also an object of this invention to provide a modular sleeve cartridge adapted for quick change of cup diameters.

BRIEF DESCRIPTION OF THE DRAWINGS

The above as well as other features and advantages of the invention can be more fully appreciated through consideration of the detailed description of the invention in conjunction with the several drawings in which:

FIG. 13 is a side elevation view of an air bag actuator for use in the redraw linkage all according to the teachings of this invention;

FIG. 14 is a rear elevation view of the flexible redraw sleeve all according to the teachings of this invention;

FIG. 15 is a longitudinal section, side elevation along lines 15—15 of FIG. 14.

DETAILED DESCRIPTION OF A PREFERRED EMBODIMENT

Figure 1:
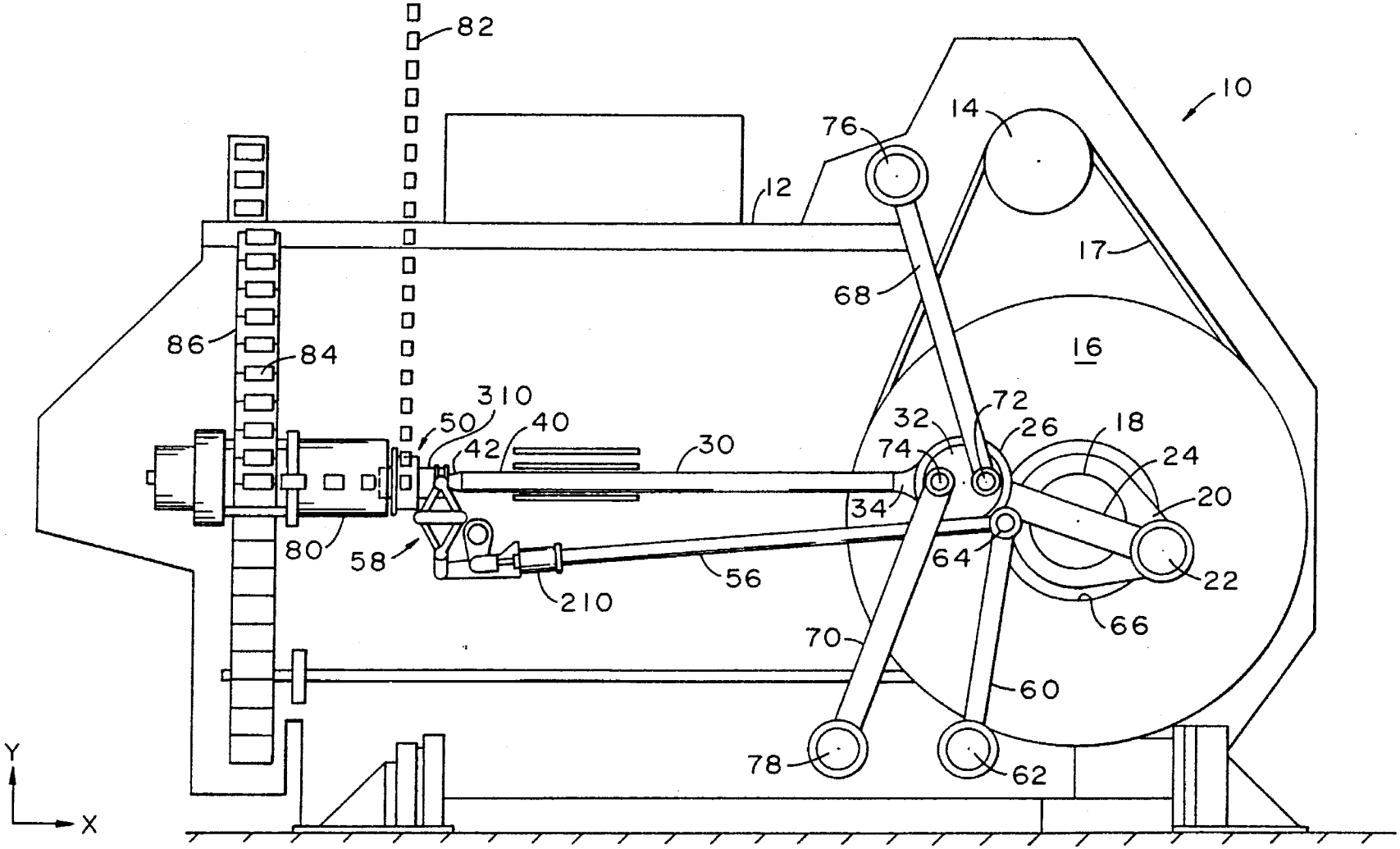
FIG. 1 is an somewhat diagrammatic view of a can body maker apparatus incorporating the features of the instant invention.
Figure 2:
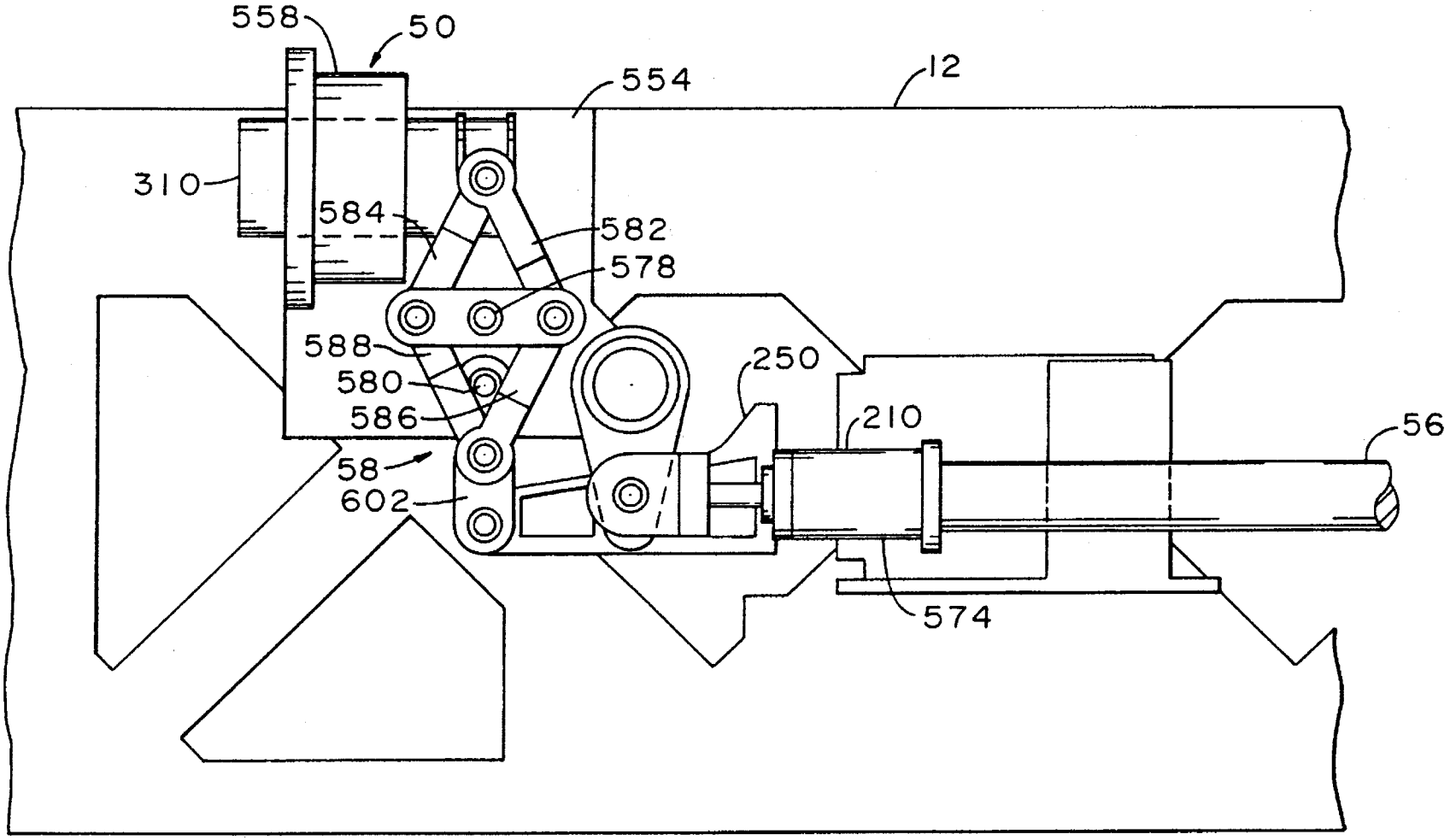
FIG. 2 is a side elevation view of the redraw linkage of the instant invention shown in a neutral position.
Figure 3:
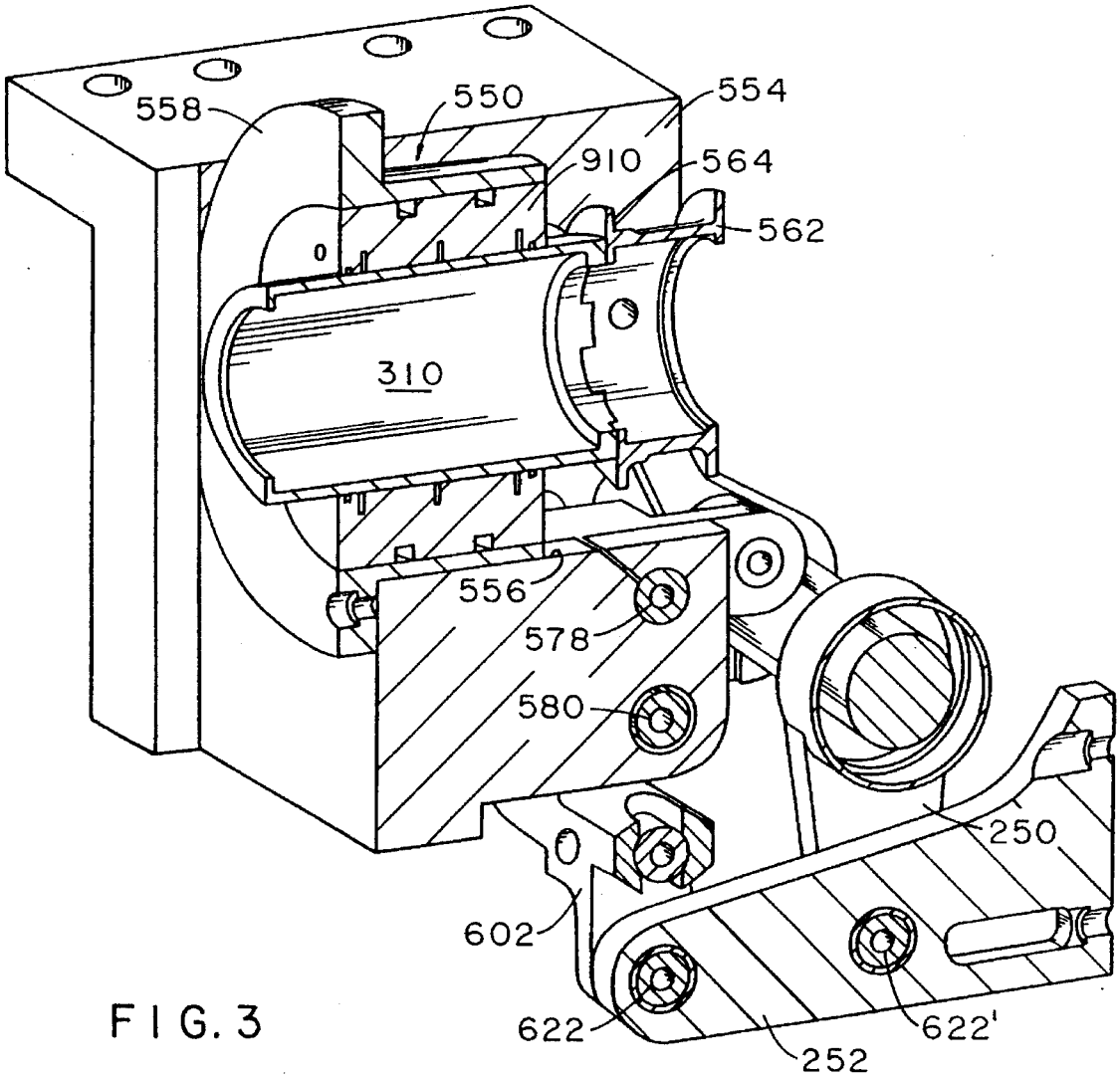
FIG. 3 is a perspective view of portions of the redraw linkage of the instant invention having portions of the redraw sleeve and support housing cut away.
Figure 4:
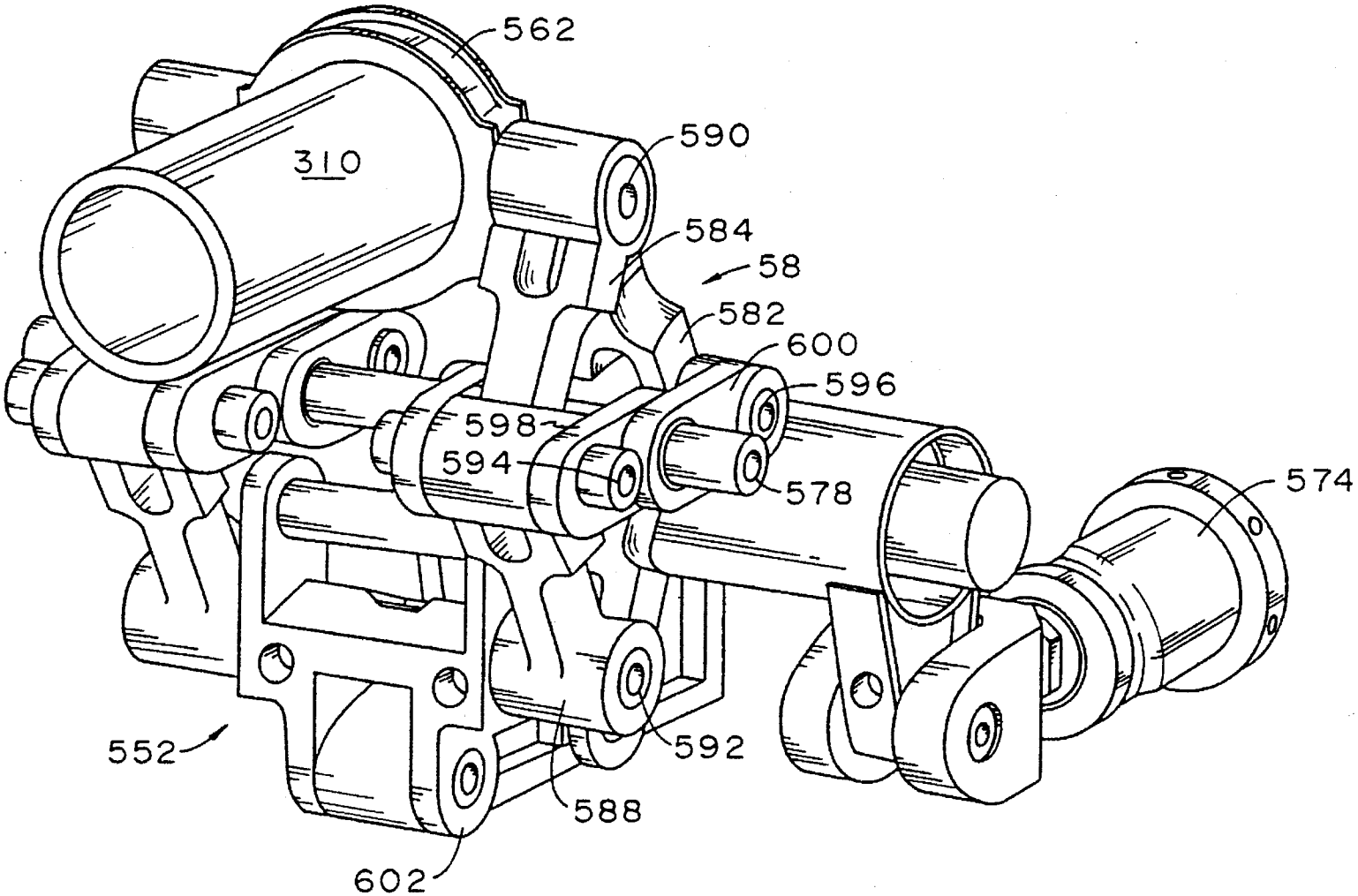
FIG. 4 is a perspective view of the redraw linkage of the instant invention removed from the redraw sleeve support housing.

The Can Body Maker and Ram Assembly:

In order to fully appreciate the various aspects of this invention, it is critical to understand certain fundamental features of a typical can body maker apparatus. Turning now to FIG. 1, a can body maker is generally indicated by the reference character 10. The can body maker 10 includes a frame or housing structure 12 having mounted thereon a motor 14 that drives a large pulley wheel 16 by belt 17. The pulley wheel 16 is fixedly mounted on one of a pair of transversely extending axially aligned crankshafts 18 with crank arms 20. The crankshafts 18 are rotatable in bearings mounted in opposed sides of the frame 12. The crank arms 20 are connected together by a crank pin 22 extending through the bearings of a main connecting rod 24 which terminates at its other end in two parallel transversely spaced apart arms for engaging the circumferential surfaces of a cross head member 26, which is part of the straight line motion assembly generally designated by the reference character 30. The pivotal point of the assembly is designated 32. The cross head member 26 is engaged circumferentially by the end of a carriage connecting rod 34 by the connecting rod 24. The carriage connecting rod 34 is pivotably connected at its other end to a ram assembly 40, in which is mounted a ram or punch generally indicated at 42.

The ram or straight line motion assembly 40 includes a side thrust resisting, upper swing lever 68 and lower swing lever 70, both bifurcated at their inner ends so as to straddle the cross head member 26. The upper swing lever 68 is pivotably connected to the cross head member 26, as indicated at 72, and the lower swing lever 70 is pivotably connected at 74 to the cross head member 26. The upper end of the upper swing lever 68 is pivotably connected to the fixed pivots 76 on frame members 12, and the lower end of the lower swing lever 70 is pivotably connected to the fixed pivots 78 on frame members 12.

The Can Body Maker Redraw Assembly:

A redraw sleeve supporting assembly generally indicated at 50 is located adjacent a tool pack housing 80 that is described below. A redraw sleeve 310 travels along an axis that is parallel to the ram 42 and movable in longitudinal or X axis motion independently of the ram. An actuator bar or pull rod 56 is fastened at its forward most end to a redraw system linkage generally indicated at 58 that is described below in connection with FIGS. 2 through 6, and at its rearward end (shown in FIG. 1), it is adapted to support a cam follower lever 60 which has its lower end mounted on a fixed pivot 62 on the frame 12. The upper end of the cam follower lever 60 includes a cam follower 64 for contacting the cam surface on the crank assembly. The rotary action of the crank is translated into the reciprocal motion of the redraw sleeve.

A tool pack housing 80, mounted in the front, or left hand portion of the can body maker as illustrated in FIG. 1, encloses a series of drawing and ironing dies (not shown) through which a work piece such as a shallow cup 82 is worked by the ram in combination with the redraw assembly 50. The cup 82 is drawn and ironed into a can body 84 and a suitable transport system 86 conveys the can body 84 from the body maker 10 for further processing. The redraw operation is the most critical function in the can making process. The redraw assembly 50 is located in front of the ram assembly 30 and next to the die housing assembly 80. The redraw assembly 50 performs the redraw operation and provides the alignment structure for the redraw sleeve 310. Generally, the redraw sleeve 310 aligns the metal cup 82 during the redraw operation and provides the correct pressure to the metal cup holding it against the redraw die face of the tool pack 80.

The redraw sleeve 310 is a component of the redraw assembly 50. The redraw assembly is slidably mounted in a fluid bearing structure that will be described below. Together with actuating bar 56, the redraw assembly moves forwardly and rearwardly as the cam followers 64 travel along a radially, inwardly facing cam surface 66. The high point of the cam travel draws the actuating bar rearwardly which in turn urges the redraw assembly into a forward position. In the forward position, the redraw sleeve holds the shallow cup against the face of the tooling through which the can end is to be drawn and ironed. Subsequently, as the cam surface in contact with the cam follower rotates from a high point to a low point, i.e., to its greatest radial distance from the crank shaft axis, the actuator bar 56 is urged forward, toward the front of the body maker. The forward movement of the actuator bar draws the redraw assembly rearwardly, away from face of the tooling. While the sleeve is withdrawn from the face of the tooling, a feed system delivers a shallow cup to the face of the tooling in the tool pack. Subsequent rotation of the cam back to its high point draws the actuator bar rearwardly, urging the redraw assembly redraw sleeve forward to engage the shallow cup. A biasing means imparts force against the redraw linkage to maintain the actuating rod in tension. Because the actuating rod is in tension, the cam follower is drawn forward and into contact with the cam surface. A biasing mechanism maintains the actuating bar 56 in tension in order to maintain the cam follower in contact with the radially inwardly facing cam surface during the rotation of the cam through its low point. If the actuator bar is not maintained in tension, the cam follower may demonstrate a tendency to lift off the cam surface.

Considering FIGS. 1 through 6, the improved redraw system 50 of this invention supports a redraw sleeve 310 in an support housing 554. The redraw sleeve reciprocates in the support housing along an X axis. The reciprocal movement is relative to the forward portion of the ram. The independent movement of the redraw sleeve assembly occurs in conjunction with and in a timed fashioned with respect to the motion of the ram assembly. A redraw sleeve support housing 554 is fixedly mounted to the frame structure 12 of the body maker 10. The housing 554 includes a bore therein as at 556 adapted to receive and retain a fluid bearing 558. The fluid bearing 558 is described in detail in conjunction with FIGS. 8 through 12. A redraw sleeve 310 is supported within the fluid bearing 558 for linear axially reciprocal motion therein. A redraw sleeve engaging collar 562 is removably connected to the sleeve 310 by means of a bayonet mount structure 564. The bayonet mount provides flexibility in the redraw assembly within preset limits of excursion. The details of the bayonet structure are described below in conjunction with FIG. 13. Contrary to conventional designs in which a carriage assembly is mounted on rails, pins, or tracks and adapted to ride along these rails to engage the redraw sleeve with a shallow cup, the instant invention has eliminated the carriage and the substantial mass associated with such a carriage. The redraw linkage mechanism 58 is pivotably connected to the collar 562 at pivot point 590 so that the actuating mechanism transmits motion only to the collar 562 and sleeve 310. The redraw sleeve supporting housing 554 and redraw sleeve fluid bearing 558 remain stationary. The redraw sleeve 310 is maintained in axial alignment by means of the fluid bearing 558. The ram 42 passes through the bore of the redraw sleeve.

Figure 5:
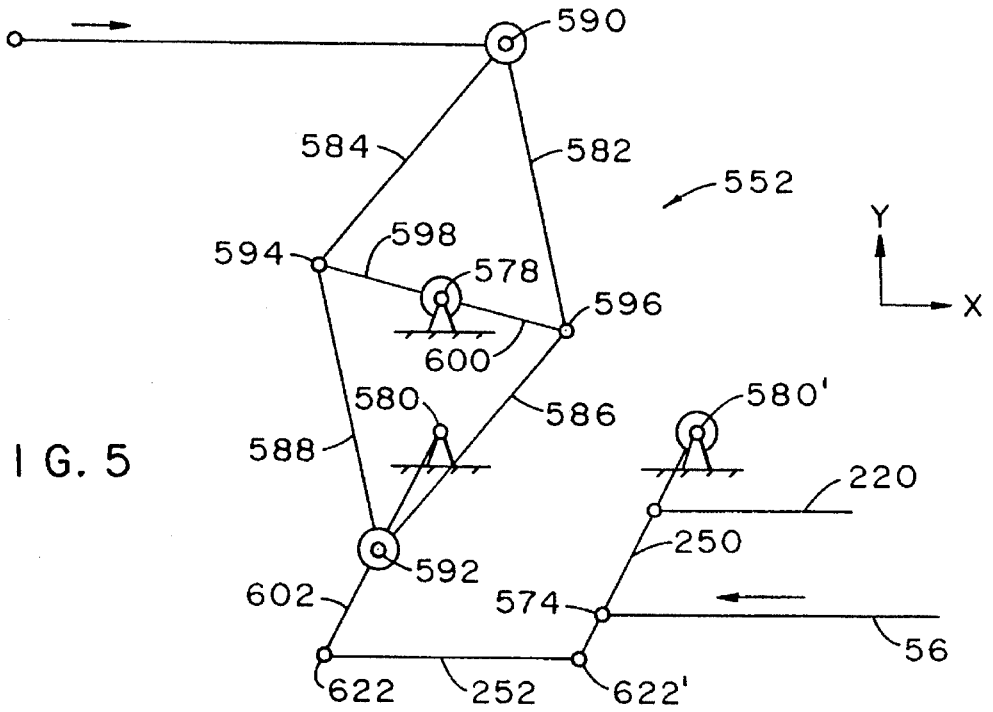
FIG. 5 is a schematic representation of the redraw linkage of this invention, illustrating the X axis motion thereof in the retracted position.
Figure 6:
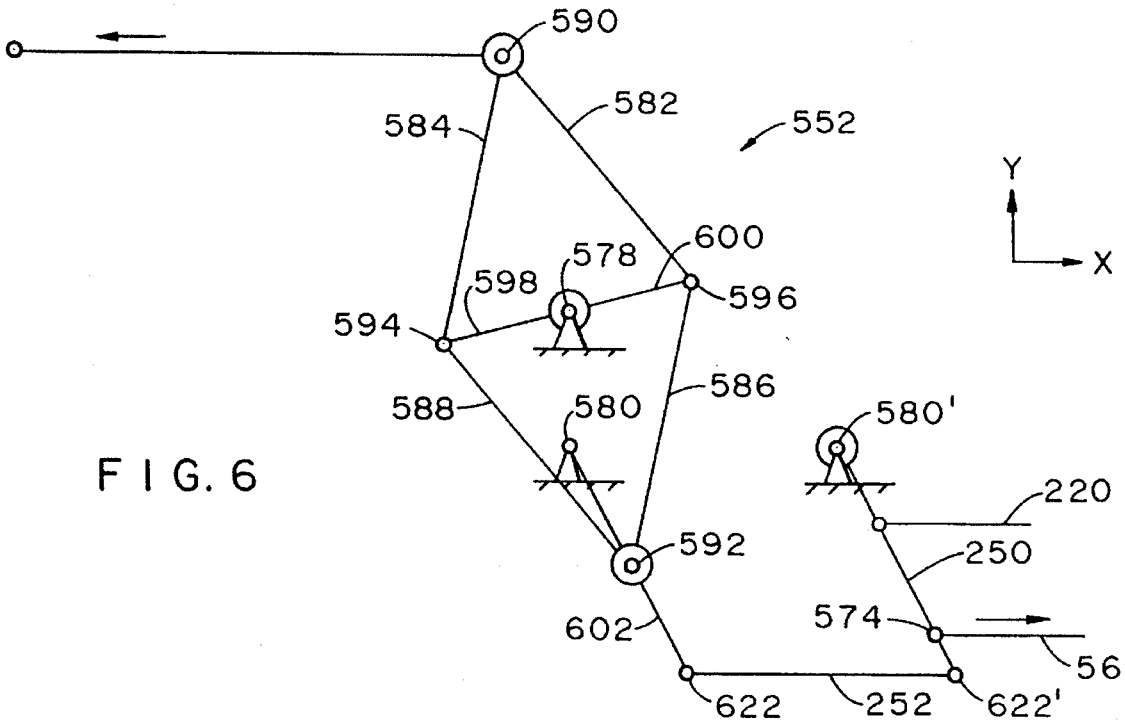
FIG. 6 is a schematic representation of the redraw linkage of this invention, illustrating the X axis motion thereof in the extended position.

The forward and retract motion for the redraw sleeve and redraw sleeve collar 562 are effected by the high-low rotation of the redraw cams generally indicated at 66 and actuating rod 56 as described above. The non-linear, reciprocating motion of the actuating rod 56 is translated into the linear motion of the redraw sleeve 310 by means of the linkage generally indicated by the referenced character 58. The operating principles of this linkage will be described in conjunction with the detailed schematic representation of the mechanical linkage as shown in FIGS. 5 and 6. It should be appreciated that while the mechanical linkage is being described in terms of relatively simple links on one side of the redraw assembly, linkage is provided on both sides of the redraw sleeve collar 562. Likewise, as the actuating rod 56 is discussed as being a single rod on one side of the can body maker, in practice, a pair of complementary rods, each disposed to one side of the can body maker center line provide additional balance to the system and to minimize any bending moment in the redraw linkage. Additionally, the biasing means is mounted along the center line of the body maker, below the ram. The redraw actuating mechanism 58 is in communication with the actuating bar 56 by means of a pre-load assembly 574. A biasing means 210 maintains the actuating rod 56 in tension and the cam follower in contact with the cam surface throughout the high-low rotation of the redraw cam system. The operation of the biasing mechanism 210 is described below.

The redraw actuating mechanism includes a first, fixed pivot point 578 on the frame 12 of the body maker 10. A second fixed pivot point 580 is also mounted in the frame 12 of the body maker. An axis extending between the first pivot point 578 and the second pivot point 580 is preferably perpendicular to the linear motion of the redraw sleeve 310 and collar 562. However, as will be appreciated, this relationship need not be perpendicular. Four links 582, 584, 586, and 588 are equal in length and form a rhombus. These four links define in combination, four pivot points at the intersection of adjacent links. The first pivot point 590 of the four pivot points formed by the rhombus of the four equal links 582–588 connects the linkage assembly 552 to the collar 562 of the redraw sleeve assembly 550. Two links 598 and 600 of equal length connect two additional pivot points 594 and 596 of the rhombus to the fixed pivot point 578. When in a neutral position such that its axis extends through movable pivot points 590 and 592 and fixed points 578 and 580, fixed pivot point 580 is mid-way between first fixed pivot point 578 and rhombus movable pivot point 592. A lever arm 602 extends from pivot point 580 through movable pivot point 592. It is to be appreciated that the specific locations described above can be varied to produce amplifications or de amplifications to the ratios of movement.

In operation, when the lever arm 602 is in its forward most position as shown in FIG. 5, the redraw sleeve is in its retract position. Likewise, when lever arm 602 is in its rearward most position as shown in FIG. 6, the redraw sleeve is in its forward most position engaging a shallow cup. As lever arm 602 pivots about second fixed pivot point 580, the pivot point 590 associated with the redraw sleeve collar 562 is compelled to move in a straight line perpendicular to the neutral or center position of pivot points 590, 578, 580 and 592.

The actuating rod is connected to the redraw linkage by means of a preload mechanism 574. In a preferred embodiment, the biasing means 220 is connected to the redraw linkage 552 at link 250. Alternatively, the preload mechanism 574 can be directly connected to the link member 602, thus eliminating links identified by reference characters 252 and 250.

Figure 16:
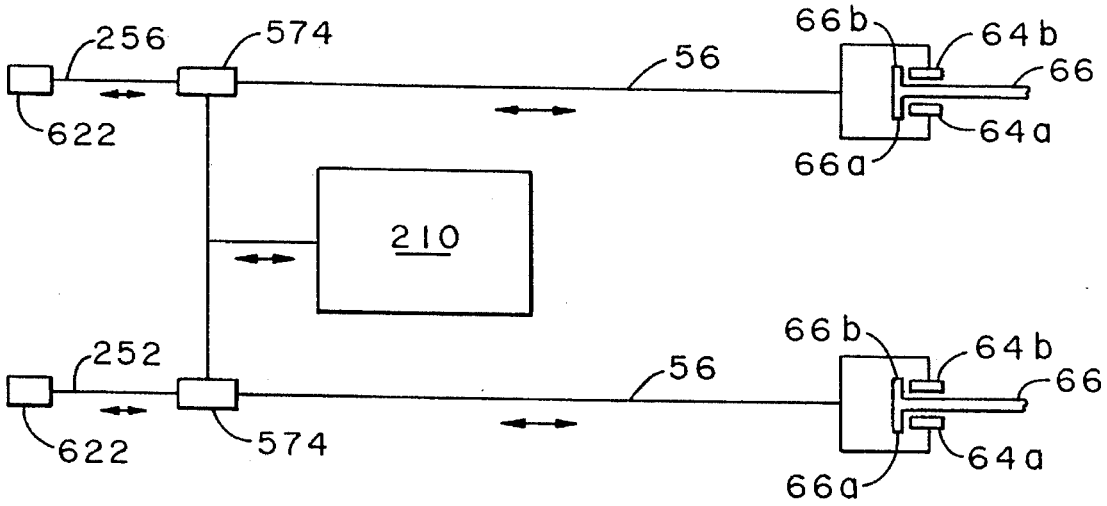
FIG. 16 is a schematical representation of a plan view of the actuating linkage, biasing mechanism, and cam system of this invention.

Returning to the preferred embodiment, link 250 and lever arm 602 form a parallel linkage connected by link 252 at pivot points 622 and 622'. Two fixed pivot points 580 and 580' are located in the body maker frame structure. The parallel linkage pivots about fixed pivot points 580 and 580'. The parallel linkage structure functions as the connecting point for the biasing means and the actuating rod. (Pivot points 574 and 622' can be the same two physical connecting point or can be removed from each other. The location of the pivot point 622' is based on the parallel structure of its associated linkage. The selection of the location of the pivot/connecting point 574 can be made in response to system requirements and the modifications to the desired travel of the parallel linkage relative to the actuating rod 56.) The forward and rearward motion of the parallel linkage, and thus the lever arm 602, is effected by a combination of the reactive forces of the biasing means 210 urging the linkage 552 forward and the cam driven actuating rod 56 pulling the parallel linkage, and thus the arm 602, rearwardly. While preferably, a single actuating rod 56 motivates the redraw linkage, in an alternative embodiment as schematically illustrated in FIG. 16, a dual actuating rod system can be employed wherein actuating rods are disposed to both the left and right side of the ram. In such a dual system, the actuator arm 56 includes a dual cam follower assembly 64 with a redraw idler arm 60. The dual cam follower assembly 64 is a pair of axially aligned cam followers **64*a* and 64*b*. A cam with a split cam track 66 having radially aligned track faces 66a and 66b is mounted on the crank shaft 18. The cam follower 64 travels along the inner faces 66 of the cam track. The biasing means 210** maintains the cam follower against the cam face travels through its high and low rotation.

Figure 7:
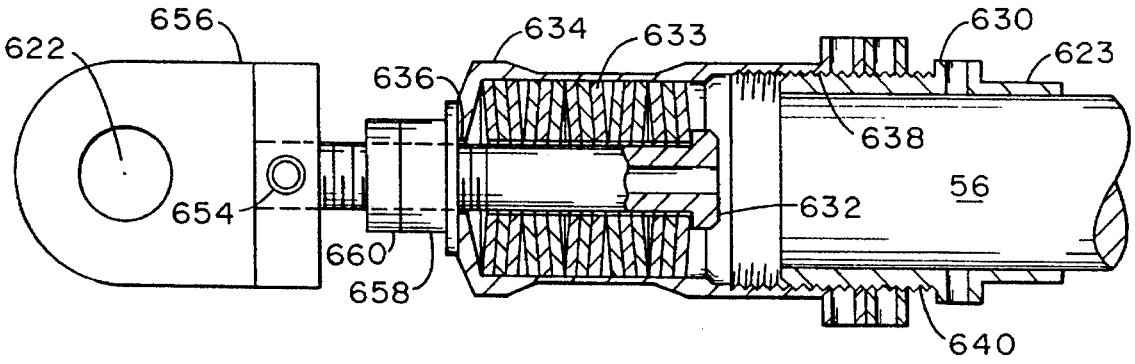
FIG. 7 is a longitudinal sectional view of the preload mechanism incorporated into the linkage of this invention.

The preload mechanism 574 is connected between the actuator bar 56 and the lever arm 602 through the parallel linkage. More particularly, a pivot point 574 is provided on the lever arm 250 at a point distal the second pivot point 580' (FIG. 7). The actuator bar 56 is attached, at the end opposite the cam follower to a housing 630. The housing 630 includes an enclosed end 623 into which the actuator arm 56 is fixedly attached to prevent rotation of the housing relative to the actuator arm. A post 632 is contained within a forward housing 634 and extends through a bore 636 in the housing 634. A number of belleville washers 633 are stacked on the post 632. The housing 634 extends over the post 632 and encloses the bevel washers 623. The belleville washer enclosure 634 has a second end provided with threads 638 for engaging complementary threads 640 on the external surface of the housing 630 where a locking collar ring prevents inadvertent dislocation. The opposite end of the post 632 is connected at 654 to the clevis 656 which in turn is connected to the parallel linkage and lever 602.

The overall length of the actuator arm mechanism and the preload of the system can be affected by adjusting the relationship of the housing 634 relative to the housing 630 by means of the threaded connections there between. Also, the preload can be adjusted by rotating threaded adjustment nut 658 and lock nut 660 on the post 632. This combination of features permits a highly adjustable preload tensioning mechanism for the actuator bar assembly.

The Stationary Redraw Sleeve Housing:

The stationary redraw sleeve support housing 554 contains a fluid bearing 910 in which the redraw sleeve is supported for reciprocal, straight line motion. The housing is mounted in the forward portion of the frame or housing of the body maker, adjacent the tool pack. The housing is positioned within the body maker by shimming to adjust alignment of the redraw sleeve. Additionally, the support housing and fluid bearing structure are removable as a unit to facilitate the substation of a second, support housing and fluid bearing structure designed to accommodate fluid bearing sleeves of a different diameter. As a result, the heretofore extremely complex re configuring of a can body maker redraw system is greatly simplified.

As can be seen in FIGS. 3 and 8 through 12, the improved fluid bearing 910 includes a support structure 912 which comprises an integral member preferably formed from steel. The support structure 912 has a flange 91 4 radially extending from the forward face 916 of the structure. The flange 914 includes bolt holes 918 for mounting the fluid bearing 91 0 in the housing 554. A generally cylindrical outer surface 920 extends between forward face and rear face 921 of the structure. The support structure 912 has a generally cylindrical inner surface 924.

Figure 8:
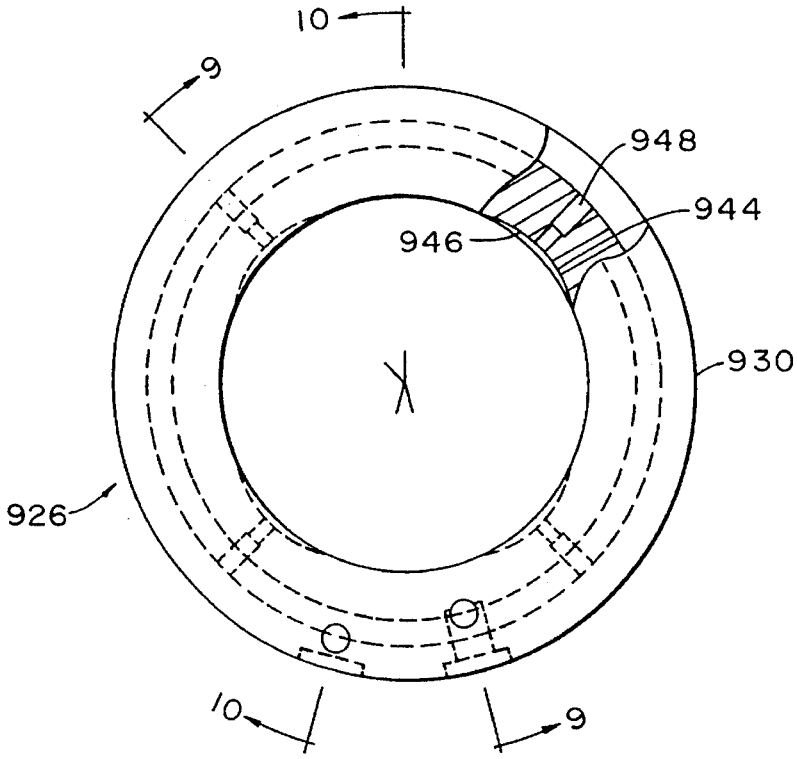
FIG. 8 is a front elevation view of the inner sleeve of a redraw fluid bearing that supports the redraw sleeve all according to the instant invention.
Figure 9:
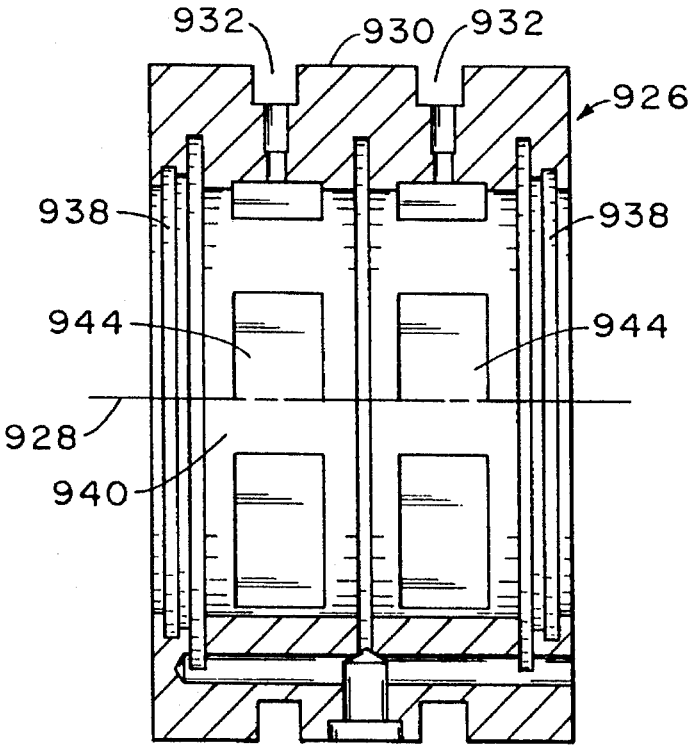
FIG. 9 is a side elevation, sectional view along lines 9—9 of FIG. 8.
Figure 10:
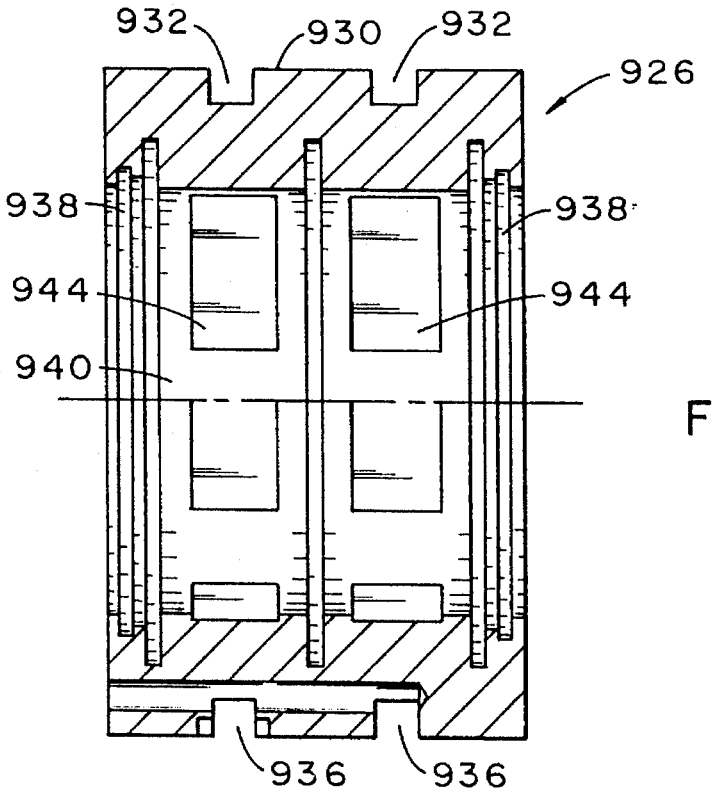
FIG. 10 is a side elevation, sectional view along lines 10—10 of FIG. 8.
Figure 12:
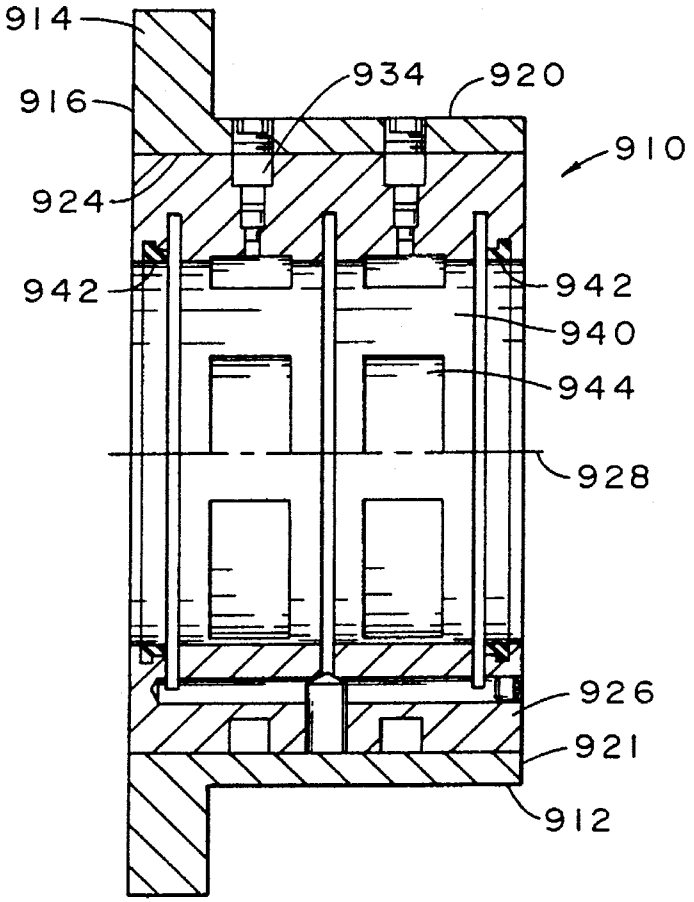
FIG. 12 is a side elevation, sectional view along lines 12—12 of FIG. 11.
Figure 11:
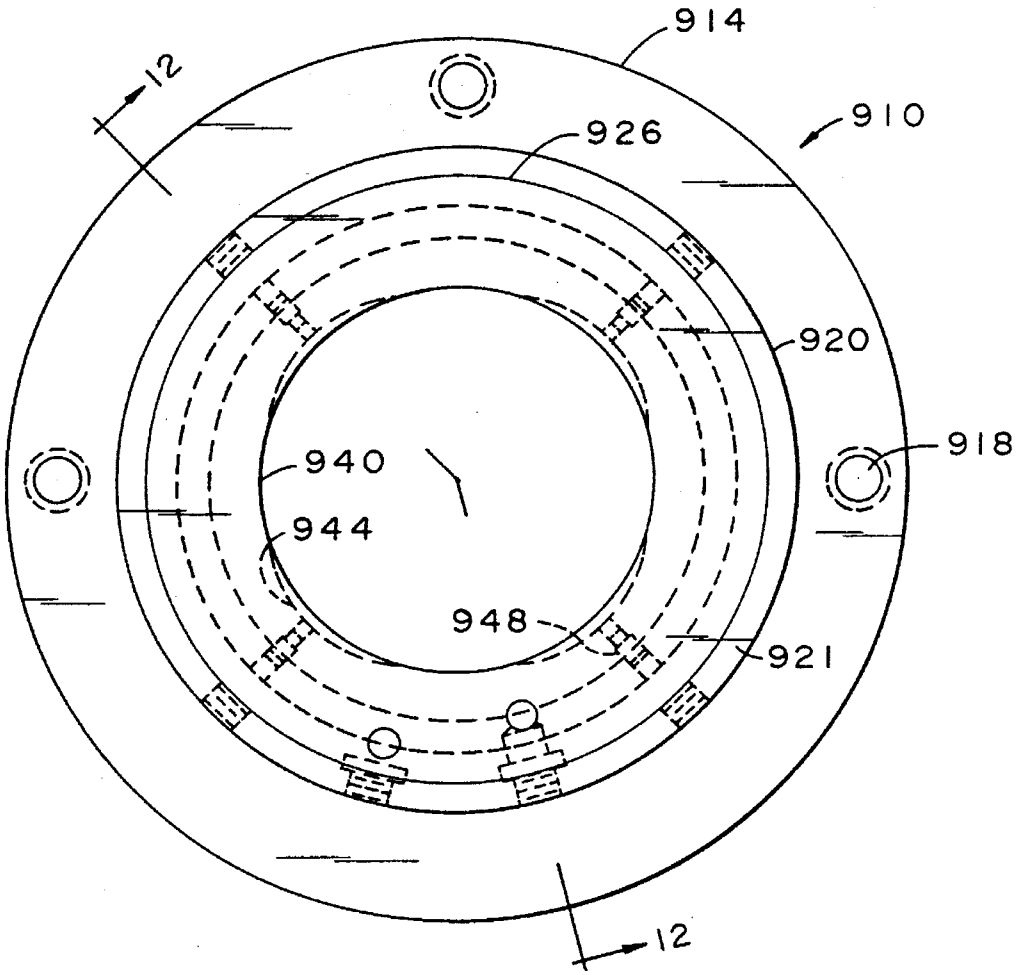
FIG. 11 is a front elevation view of the redraw fluid bearing mounted in a fluid bearing support structure all according to the instant invention.

As more clearly shown in FIGS. 8, 9 and 10, an elongated body 926 has a longitudinal axis 928 which, when the elongated body 926 is mounted in the support structure 912 (of FIGS. 11 and 12) coincides with the central axis thereof. The elongated body 926 has a generally cylindrical outer surface 930 in which are formed two spaced apart, radially, inwardly, extending annular recesses 932 which are adapted for form, in combination with the inner surface 924 of the support structure 912 annular passage ways 934, each of which is in fluid communication with an inlet opening 936.

A plurality of relatively narrow radially, inwardly extending annular grooves 938 are formed in the inner surface 940 of the elongated body 926 and in which are seated elastomeric seals 942. The seals function to eliminate fluid flow between the cylindrical outer surface of the redraw sleeve and the inner surface 940 of the elongated body 926. The outer surface 930 is manufactured to be in close tolerance with the inner surface 924 of the support structure 912.

The inner surface 940 of the elongated body 926 is generally cylindrical and has a plurality of radially, outwardly extending pocket cavities 944. Each pocket cavity 944 has an arcuate surface 946 which is a portion of a cylindrical surface having an axis which is offset from the longitudinal access of the elongated body 926.

The annular passage ways 934 are in fluid communication with radially extending, generally cylindrical passage ways 948 which are, in turn, in fluid communication with each pocket cavity 944. Suitable, adjustable fittings (not shown) can be provided in the passage ways 948 to control the volume of fluid flowing into each of the several pocket cavities 946.

Each pocket cavity 944 is in fluid communication with radially extending, generally cylindrical fluid return passage ways 950. The fluid return passageways are disposed in the inner surface 940 of the elongated body 926. Such fluid return passageways are preferably located on each side of the pocket cavities 944, thus providing a total of three fluid return passage ways. A fluid outlet port is provided at convey the fluid from the fluid bearing. Fluid is then circulated by conventional means for reintroduction into the fluid bearing under pressure.

Another advantage of the instant fluid bearing design is flexibility in the change over of the body maker from manufacturing cans of a first diameter to cans of a second, different diameter. Typically, a significant portion of the redraw assembly must be removed to effect such a change over. Through the application of the improved redraw sleeve structure, as described below, the fluid bearing is adapted to accommodate a series of redraw sleeves each having the same outside diameter. However, each of the sleeves is configured to cooperate with dies of a specific, complementary configuration as well as a ram of the desired diameter.

The Air Bag Actuator Redraw Biasing Mechanism.

The improved biasing system for use in combination with the redraw linkage of the instant invention eliminates the conventional requirement of complex air cylinders, surged tanks and associated pneumatic plumbing. The improved biasing assembly is generally indicated at the reference character 210 as shown in FIG. 13. The assembly 210 includes an air spring actuator 21 2 having a first end 214 and a second end 216. The actuator 212 is a commercially available product designed and sold by Firestone under the trademark Firestone Airstroke Actuator. The actuator 212 is an air spring consisting of a rubber/fabric liner 218 having at one end a bellows 219. The actuator bellows 219 are attached to a fixed member or piston 221 about which the bellows rolls as the actuator is compressed and then expands during operation of the redraw system. The actuator contains a column of air pressurized to a predetermined value. The liner and bellows do not provide force or support the load. Rather, support is provided by the column of air contained in the actuator 212. The standard liner is made of four layers comprising an inner layer of calendered rubber, one ply of fabric reinforced rubber, a second ply of fabric reinforced rubber, and an outer cover of calendered rubber.

An optional air spring housing can be employed with the actuator 212. A description of the actuator housing as well as an additional application of the actuator as a retrofit to conventional body maker redraw systems is described in Applicants' copending U.S. patent application Ser. No. 174,237, entitled, "Improved Can Body Maker With Air Actuator Redraw Mechanism."

The outer face of the air actuator includes a plate 220 that is adapted to support a clevis 234 which is in mechanical communication with redraw linkage 58 urging the linkage lever arm 602 forward and into the redraw sleeve retract position, clearing the redraw sleeve from the tool pack face. This action draws the actuator rod 56 forward, maintaining it in tension and in contact with the inner cam surface 66.

In operation, the cam follower and redraw idler arm create the reciprocal motion of the redraw sleeve as the cam follower responds to the rotation of the redraw cam. Beginning with the low point of the cam, the push rod is in its forward most position relative to the tool pack. The air spring actuator is in its most axially extended position while the redraw sleeve is at its greatest axial distance from the tool pack. As the cam rotates into its high point, it pulls the actuator rod rearwardly. The parallel linkage is pivoted rearwardly, compressing the air spring actuator and moving the redraw sleeve forward, toward the tool pack. The physical compression of the air spring actuator 212 reduces the volume of the air bellows which in turn compresses the gases contained therein. The compression heats the column of air contained within the bellows, thus generating a reactive pressure within the bellows as the geared gas tends to expand. As the cam rotates from the high point to the low point, the compressed heated gas of the air spring actuator provides the axial displacement to maintain the actuator bar in contact with the cam face and to push the parallel linkage forward, retracting the redraw sleeve from the tool pack. The actuator 212 can be adjusted according to set the no-load pressure of the air within the actuator. Air fittings are provided as at 240 to charge the actuator 212 to a desired pressure.

The Flexible Redraw Sleeve.

In order to maintain an accurate thin-wall dimension, a minimum draw pressure must be applied evenly around the cup and the redraw sleeve aligned precisely relative to the ram and the cup to pre-established specifications. If a minimum pressure on the cup is not maintained or if the redraw sleeve is not precisely aligned, quality problems in the drawing and ironing process can result. Such problems include extensive wear or damage to the redraw motion assemblies, the redraw sleeve itself, and can bodies having extensive structural damage. Can body damage can include flange wrinkling under the face of the redraw sleeve, can shell crushing, and can shell misfeed, any of which can result in a complete shutdown of the body maker and can line. These potential problems are substantially eliminated by the redraw sleeve 310 that is adaptable to be used in combination with the fluid bearing assembly of the instant invention. Additionally, as described in applicants' co-pending U.S. patent application Ser. No. 174,134, entitled Improved Can Body Maker With Flexible Redraw Sleeve," the redraw sleeve 310 can be adapted for incorporation into the redraw carriage of conventional body maker redraw systems.

The redraw sleeve 310 includes a cylindrical body portion 312 having an outer surface 314 and an inner surface 316. The cylindrical body 312 has a first end 318 and a second end 320. The cylindrical body portion 312 defines a central bore 322 through which a body maker ram passes during the working of the shallow cup. The first end 318 of the cylindrical body is adapted to be removably mounted into a redraw carriage sleeve assembly generally indicated at 324. The assembly 324 includes a seat portion having a locking member. Slight misalignment between the redraw sleeve 310 and the can body maker ram can be compensated for by the flexibility afforded by the redraw sleeve 310. Turning now to FIGS. 14 and 15, a redraw sleeve 310 includes a first end 318 adapted to be mounted to the redraw linkage. The second end 320 contacts a shallow cup 82 during the forming of the deep shaped can body. The first end 318 includes a bayonet-style locking structure generally indicated by the referenced character 350. A redraw linkage includes the female half 352 of the bayonet mount structure. A locking pin as at 380 can be inserted into the sleeve and redraw carriage bayonet mount in order to inhibit undesired displacement of the sleeve relative to the carriage. It should be appreciated that any number of techniques can be employed to rigidly yet detachably secure the sleeve 310 into the redraw linkage.

The second end 320 of the cylindrical body 312 which forms the redraw sleeve 310 includes a radially, inwardly directed, circumferentially disposed deformable member 360. The deformable member defines a bore 322 through which the ram of the can body maker passes during the redraw of a shallow cup. The deformable face 360 includes a shell contacting surface 362 and an opposed surface 364. The contacting surface 362 and the opposed surface 364 extend from the second end of the cylindrical body 312 and are joined by a wall 366. As can be seen, the opposed surface 364 in combination with the inner surface 316 of the cylindrical body forms a step portion 368. This internal step-like feature is at the juncture of the deformable member and the cylindrical body portion. The inside diameter of the circle defined by the wall 366 of the deformable face 360 is slightly greater than the outside diameter of the ram. The ram must pass through the central bore of the sleeve and the opening defined by the wall 366 during the drawing and ironing process. Heretofore, it had been the practice to provide a bore of a constant diameter through the sleeve so that the interior of the sleeve was in close contact with the outside diameter of the ram. Such prior art redraw sleeves possess significant mass. The shell contacting surface in the prior art design is the terminal portion of the thick walled sleeve, i.e., the forward portion of the sleeve between its inner and outer surfaces.

The redraw sleeve of this invention provides a significant advancement over current practice. For example, in one embodiment, the contacting surface 362 can be substantially perpendicular to an axis defined by the cylindrical body portion 312. Preferably, the deformable member 360 is an integral portion of the cylindrical body portion 312. The radially, inwardly directed, circumferentially disposed, deformable member can be non-uniform in thickness. The deformable member can taper from a first thickness, approximate the cylindrical body as at the juncture 368, to a second, lesser thickness distal the cylindrical body portion, or at the wall 366. In an alternative embodiment, the contacting surface can be at an angle that is greater than zero, up to approximately 5° (as shown in phantom) relative to a plane 'P' drawn through the outside edges 370 of the cylindrical body 312. The cylindrical body portion 312 experiences some deformation and stiffness and spring rate can be modified by changes to the sidewall geometry, including for example local relief slots and wall thickness, as well as by modifications to the material properties of the sleeve. In operation, the portion of the deformable member approximate the wall 366 first contacts the shallow cup inner surface. Any misalignment in the redraw sleeve 310 is compensated for by the flexibility of the deformable member 360. This tends to ensure that a uniform distribution of force is applied to the shallow cup immediately prior to the contact of the shall cup by the can body maker ram.

In existing can body redraw sleeves, it is the practice to provide a cylindrical body of a constant thickness that terminates an edge which contacts the shallow cup. In such arrangements it is the actual end of the wall forming the cylindrical body which contacts the shallow cup. This results in a rather thick-walled redraw sleeve having significant mass. In the instant invention, the total mass of the redraw sleeve is significantly reduced through the use of the thin cylindrical wall in combination with the deformable member. The thin wall section 382 of the cylindrical body 312 eliminates a significant total portion of the mass of the cylindrical body between the rearward step section 384 and the forward step section or juncture 368. The width of the deformable member as measured from the outside of the cylindrical body 370 to the inside wall 366 is comparable to the width of the prior art thick-walled redraw sleeves. Significant improvements are available due to the light weighting and consequent reduction of mass being displaced by the redraw carriage during can body making operations. The total mass of the redraw sleeve is significantly reduced through the use of the deformable member. The width of the deformable member as measured from the outside of the cylindrical body 370 to the inside wall 366 is comparable to the width of the prior art thick-walled redraw sleeves. When using an improved redraw sleeve that incorporates the mounting structure shown in FIGS. 14 and 15, significant improvements are available due to the light weighting and consequent reduction of mass being reciprocated during can body making operations.

The present invention has been described in an illustrative manner. It is to be understood that the terminology which has been used is intended to be in the nature of words of descriptive rather than limitation. Many modifications and variations of the preset invention are possible in light of the above teachings. Therefore within the scope of the appended claims, the present invention may be practiced otherwise than as specifically described.

What is claimed is:

1. An apparatus for the manufacture of can bodies having:

(a) a frame;

(b) drive mechanism including a cam surface and a crank, both adapted for rotation about a first axis located in said frame;

(c) ram means mounted in said frame for reciprocal, straight line motion;

(d) rod means operatively connecting said crank with said ram means for imparting reciprocal motion to said ram means;

(e) redraw means operating in cooperation with said ram means for forming can blanks into elongated can bodies, said redraw means mounted in said frame for reciprocal straight line motion;

(f) actuating bar means operatively associated with said cam surface such that said cam surface imparts reciprocal motion to said actuating bar means;

(g) biasing means for maintaining said actuating bar means in operative communication with said cam means; and (h) redraw linkage means in mechanical communication with said redraw means and said actuating bar means; said redraw linkage including:

(i) a first pivot point (578);

(ii) a second pivot point (580) wherein an axis is defined between said first and second pivot points (578 and 580);

(iii) four links (582, 584, 586, 588) of a first predetermined length forming a rhombus and defining in combination four pivot points at the intersection of adjacent links, wherein a first rhombus pivot point (590) is on the redraw means;

(iv) a lever arm having a first end mounted for pivotal motion about said second pivot point (580) and a second end downwardly depending therefrom, and on which lever arm is mounted a second rhombus pivot point (592), and wherein a third and fourth rhombus pivot points (594 and 596) are disposed between said first and second rhombus pivot points; said second pivot point (580) being disposed between the first pivot point (578) and the second rhombus pivot point (592); and (v) first and second lateral links (598 and 600) connected between said first pivot point (578) and said third and fourth rhombus pivot points (594 and 596), wherein the pivoting motion of said lever arm about said second pivot point (580) is translated into the reciprocating linear motion of said redraw means.

2. The apparatus according to claim 1 wherein the first and second pivot points are in fixed locations in the can body maker frame, and the axis defined between the first and second pivot points is generally perpendicular to the linear motion of said redraw means.

3. The apparatus according to claim 1 wherein the can body maker apparatus biasing means is an air spring assembly.

4. The apparatus according to claim 1 wherein the redraw means includes a fluid bearing means mounted in the can body maker and a redraw sleeve mounting means for supporting a redraw sleeve, movably mounted in said fluid bearing means for reciprocal straight line motion.

5. The apparatus according to claim 4 wherein the redraw linkage lever arm is in mechanical communication with the redraw sleeve mounting means.

6. The apparatus according to claim 4 wherein the redraw sleeve is supported in the redraw sleeve mounting means by a bayonet mounting means.

7. The apparatus according to claim 1 wherein the redraw means includes a redraw sleeve mounting means and a removable redraw sleeve, said redraw sleeve comprising a generally cylindrical body portion with a first end adapted to engage said redraw sleeve mounting means, and an opposite, second end for contacting a shallow cup blank, said second end having a radially inwardly directed, circumferentially disposed, deformable face.

8. The apparatus according to claim 7 wherein the radially inwardly directed, circumferentially disposed, deformable face defines an internal step like feature at the juncture of said deformable face and the cylindrical body portion.

9. The apparatus according to claim 7 wherein the radially inwardly directed, circumferentially disposed, deformable face has an inner surface and an outer surface and wherein the outer surface is substantially perpendicular to the cylindrical body portion.

10. The apparatus according to claim 7 wherein the radially inwardly directed, circumferentially disposed, deformable face has an inner surface and an outer surface and wherein the outer surface is substantially perpendicular to the cylindrical body portion and is substantially parallel to said inner surface.

11. The apparatus according to claim 7 wherein the radially inwardly directed, circumferentially disposed, deformable face is integral with the cylindrical body portion.

12. The apparatus according to claim 7 wherein the radially inwardly directed, circumferentially disposed, deformable face is non-uniform in thickness tapering from a first thickness proximate the cylindrical body portion to a second, lesser thickness distal the cylindrical body portion.

13. The apparatus according to claim 7 wherein the radially inwardly directed, circumferentially disposed, deformable face tapers outwardly from a plane defined the second end of the cylindrical body portion.

14. The apparatus according to claim 13 wherein the radially inwardly directed, circumferentially disposed, deformable face tapers outwardly from a plane defined the second end of the cylindrical body portion at an angle greater than zero and up to approximately 5 degrees.

15. The apparatus according to claim 1 wherein the biasing means comprises: an air spring actuator having a first end and a second end; mounting means adapted to secure said actuator first end to said apparatus' frame; mounting means adapted to operatively attach said actuator second end to the redraw linkage.

16. A redraw linkage apparatus for imparting reciprocating linear motion to a redraw sleeve mounted for reciprocal movement in a can body maker apparatus comprising:

(i) a first fixed pivot point;

(ii) a second fixed pivot point wherein an axis extending between said first and second pivot points and is perpendicular to the linear motion of said redraw carriage;

(iii) four links having predetermined length forming a rhombus and defining in combination four pivot points at the intersection of adjacent links, wherein a first rhombus pivot point is on the redraw carriage;

(iv) a lever arm having a first end mounted for pivotal motion about said second pivot point and a second end downwardly depending therefrom, and on which lever arm is mounted a second rhombus pivot point, and wherein a third and fourth rhombus pivot points are disposed between said first and second rhombus pivot points; said second pivot point being disposed between the first fixed pivot point and the second rhombus pivot point;

(v) first and second lateral links connected between said first fixed pivot point and said third and fourth rhombus pivot points, wherein the pivoting motion of said lever arm about said second fixed pivot point is translated into the reciprocating linear motion of said redraw sleeve.

17. The redraw linkage apparatus according to claim 16 wherein the can body maker apparatus includes a cam actuated bar and said bar is in pivotal mechanical communication with the redraw linkage lever arm such said redraw linkage apparatus translates the motion of said lever arm into reciprocating linear motion of the redraw carriage.

18. The redraw linkage apparatus according to claim 17 wherein the can body maker apparatus includes a biasing means in communication with the bar wherein the bar is urged into contact with a redraw cam means.

19. In an apparatus for the manufacture of can bodies having:

(a) a frame;

(b) drive mechanism including a cam surface and a crank, both adapted for rotation about a first axis mounted in said frame;

(c) ram means mounted in said frame for reciprocal, straight line motion;

(d) rod means operatively connecting said crank with said ram means for imparting reciprocal motion to said ram means;

(e) redraw means operating in cooperation with said ram means for forming can blanks into elongated can bodies mounted in said frame for reciprocal straight line motion;

(f) actuating bar means operatively connecting said cam surface with said redraw means for imparting reciprocal straight line motion to said redraw means; and (g) biasing means for maintaining said actuating bar means in contact with said cam means; said biasing means comprising an air spring actuator having a liner defining at one end thereof a bellows that is attached to a fixed piston about which the bellows rolls as said air spring actuator is compressed and then expanded during operation, said liner defining therein a column of air pressurized to predetermined value, a first end and a second end; mounting means adapted to secure said actuator first end to said frame; and mounting means adapted to secure said actuator second end to said actuating bar wherein said air spring actuator urges said actuating bar in contact with said cam surface.

20. A redraw linkage apparatus for imparting reciprocating linear motion to a redraw sleeve mounted for reciprocal movement in a can body maker apparatus comprising:

(i) a first pivot point;

(ii) a second pivot point wherein an axis is defined between said first and second pivot points;

(iii) four links of a first predetermined length forming a rhombus and defining in combination four pivot points at the intersection of adjacent links, wherein a first rhombus pivot point is connected to the redraw carriage;

(iv) a lever arm having a first end mounted for pivotal motion about said second pivot point and a second end downwardly depending therefrom, and on which lever arm is mounted a second rhombus pivot point, and wherein a third and fourth rhombus pivot points are disposed between said first and second rhombus pivot points; said second pivot point being disposed between the first fixed pivot point and the second rhombus pivot point;

(v) first and second lateral links connected between said first pivot point and said third and fourth rhombus pivot points, wherein the pivoting motion of said lever arm about said second pivot point is translated into the reciprocating linear motion of said redraw sleeve.

21. In an apparatus for the manufacture of can bodies having:

(a) a frame;

(b) drive mechanism including a cam surface and a crank, both adapted for rotation about a first axis mounted in said frame;

(c) ram means mounted in said frame for reciprocal, straight line motion;

(d) rod means operatively connecting said crank with said ram means for imparting reciprocal motion to said ram means;

(e) redraw sleeve means operating in cooperation with said ram means for forming can blanks into elongated can bodies mounted in said frame for reciprocal straight line motion;

(f) actuating bar means operatively connecting said cam surface with said redraw means for imparting reciprocal straight line motion to said redraw means;

(h) fluid bearing means mounted in said frame for supporting said redraw sleeve means.

* * * * *